US011118239B2

(12) United States Patent
Wilden et al.

(10) Patent No.: US 11,118,239 B2
(45) Date of Patent: Sep. 14, 2021

(54) HEAT TREATMENT METHOD AND HEAT TREATMENT DEVICE

(71) Applicant: SCHWARTZ GMBH, Simmerath (DE)

(72) Inventors: Frank Wilden, Simmerath (DE); Jörg Winkel, Nideggen-Schmidt (DE); Andreas Reinartz, Monschau (DE)

(73) Assignee: Schwartz GmbH, Simmerath (DE)

( * ) Notice: Subject to any disclaimer, the term of this patent is extended or adjusted under 35 U.S.C. 154(b) by 273 days.

(21) Appl. No.: 16/078,968

(22) PCT Filed: Jan. 25, 2017

(86) PCT No.: PCT/EP2017/051511

§ 371 (c)(1),
(2) Date: Aug. 22, 2018

(87) PCT Pub. No.: WO2017/144217

PCT Pub. Date: Aug. 31, 2017

(65) Prior Publication Data

US 2019/0024199 A1 Jan. 24, 2019

(30) Foreign Application Priority Data

Feb. 23, 2016 (DE) ..... 10 2016 202 766.2

(51) Int. Cl.
*C21D 1/673* (2006.01)
*C21D 8/00* (2006.01)
(Continued)

(52) U.S. Cl.
CPC ..... *C21D 1/673* (2013.01); *C21D 1/19* (2013.01); *C21D 1/34* (2013.01); *C21D 8/005* (2013.01);
(Continued)

(58) Field of Classification Search
CPC . C21D 1/673; C21D 1/19; C21D 1/34; C21D 8/005; C21D 9/0062; C21D 9/0068;
(Continued)

(56) References Cited

U.S. PATENT DOCUMENTS 5,630,322 A * 5/1997 Heilmann ..... C21D 1/62 62/434
2011/0073222 A1* 3/2011 Strandell ..... F16C 33/62 148/575

FOREIGN PATENT DOCUMENTS

CN 101006189 7/2007
CN 101772585 7/2010
(Continued)

OTHER PUBLICATIONS

Dossett et al. ("Practical Heat Treating, Chap. 2 Fundamentals of the Heat Treating of Steel." ASM International, Ohio (2006): 9-25.) (Year: 2006).*
(Continued)

*Primary Examiner* — Anthony J Zimmer
*Assistant Examiner* — Ricardo D Morales
(74) *Attorney, Agent, or Firm* — Occhiuti & Rohlicek LLP

(57) ABSTRACT

In one or more first regions of a steel component, a primarily austenitic microstructure can be produced from which a mainly martensitic microstructure can be brought about through a quenching process. In one or more second regions of the component, a mainly ferritic-pearlitic microstructure can be brought about. In one or more third regions, a mainly bainitic microstructure can be brought about. The component is first heated to a temperature below the AC3 temperature in a first furnace, and transferred into a treatment station. The component can be cooled during the transfer. In the treatment station, the first and third regions are brought to a temperature above the austenitization temperature. Only
(Continued)

Figure 1:
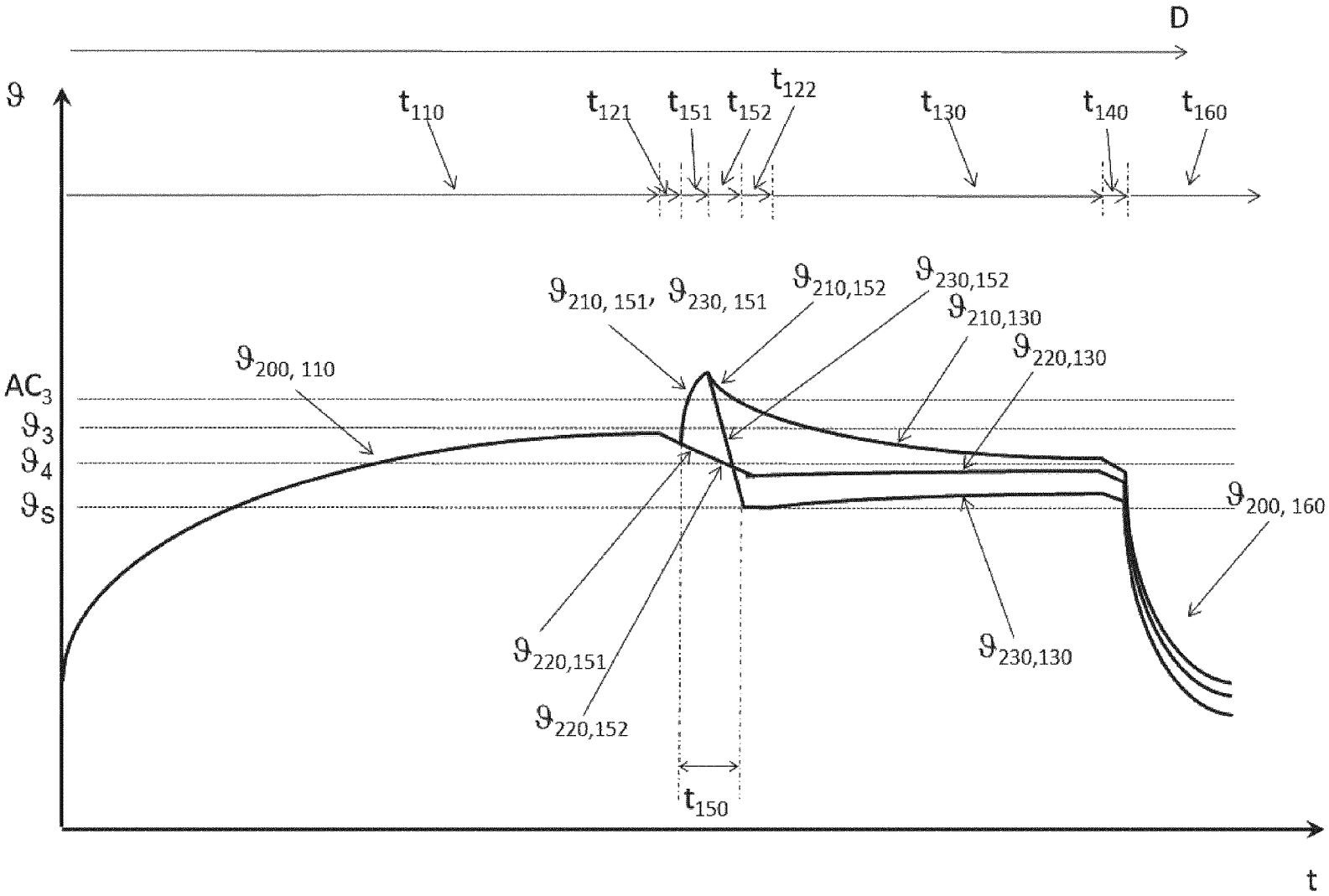

the third regions are cooled to a cooling stop temperature ϑs. The component is transferred into a second furnace, with a temperature lying below the AC3 temperature. There, the temperatures of the three different regions approximate one another.

10 Claims, 7 Drawing Sheets

(51) Int. Cl.

| | |
|---|---|
| ***C21D 9/00*** | (2006.01) |
| ***C21D 1/19*** | (2006.01) |
| ***C21D 1/34*** | (2006.01) |
| ***C21D 1/667*** | (2006.01) |
| ***C21D 1/62*** | (2006.01) |

(52) U.S. Cl.
CPC ..... *C21D 9/0062* (2013.01); *C21D 9/0068* (2013.01); *C21D 1/62* (2013.01); *C21D 1/667* (2013.01); *C21D 2211/002* (2013.01); *C21D 2211/005* (2013.01); *C21D 2211/008* (2013.01); *C21D 2211/009* (2013.01); *C21D 2221/00* (2013.01)

(58) Field of Classification Search
CPC .... C21D 1/62; C21D 1/667; C21D 2211/002; C21D 2211/005; C21D 2211/008; C21D 2211/009; C21D 2221/00
See application file for complete search history.

(56) References Cited

FOREIGN PATENT DOCUMENTS

| | | | | |
|---|---|---|---|---|
| CN | 101868556 | | 10/2010 | |
| CN | 102191362 | | 9/2011 | |
| CN | 103534364 | | 1/2014 | |
| DE | 102010048209 | | 1/2012 | |
| DE | 102012216468 | | 1/2014 | |
| DE | 102014201259 | | 7/2015 | |
| EP | 2548975 | | 1/2013 | |
| EP | 2395116 | | 12/2013 | |
| EP | 2679692 | | 1/2014 | |
| EP | 2679692 | A1 * | 1/2014 | ..... C21D 9/46 |
| EP | 2905346 | | 8/2015 | |
| KR | 20140081619 | | 7/2014 | |

OTHER PUBLICATIONS

H. Altena, K. Buchner. "Process technology and plant design for bainite hardening." La Metallurgia Italiana, 2016, pp. 23-26.
European Office Action dated Jun. 3, 2020 in EP Application No. 17704171.2.

* cited by examiner

HEAT TREATMENT METHOD AND HEAT TREATMENT DEVICE

CROSS REFERENCE TO RELATED APPLICATIONS

This application is a National Phase under 35 U.S.C. 371 of International Application No. PCT/EP2017/051511 filed on Jan. 25, 2017, which claims priority to German Application No. 10 2016 202 766.2 filed Feb. 23, 2016, the contents of which are hereby incorporated by reference in their entirety.

The invention relates to a method and to a device for targetedly heat-treating individual zones of a steel component.

Several applications in various technical industries require high-strength sheet metal parts having a low part weight. For example, the vehicle industry aims to reduce the fuel consumption of motor vehicles and to decrease $CO_2$ emissions while simultaneously increasing occupant safety. The need for vehicle body components that have a favourable strength to weight ratio is therefore significantly increasing. These components include in particular A and B columns, side-impact protection supports in doors, sills, frame parts, bumpers, crossmembers for the floor and roof and front and rear longitudinal supports. In modern motor vehicles, the body-in-white that comprises a safety cage usually consists of a hardened steel sheet having a strength of approximately 1,500 MPa. In this case, steel sheets coated with several layers of Al—Si are used. The process of so-called press-hardening has been developed in order to produce a component from hardened sheet steel. In this case, steel sheets are first heated to the austenite temperature, then placed in a press die, quickly shaped and rapidly quenched to less than the martensite start temperature by the water-cooled die. A hard, strong martensite structure having a strength of approximately 1,500 MPa is produced. However, the elongation at break of a steel sheet hardened in this way is only small. The kinetic energy of an impact therefore cannot be adequately converted into deformation heat.

For the automobile industry, it is therefore desirable for it to be possible to produce vehicle body components that comprise a plurality of different elongation and strength zones within the component, so that one component comprises rather strong regions (called first regions in the following) and maximally extensible regions (called second regions in the following) and extensible regions (called third regions in the following) that can also be formed. On the one hand, components having a high strength are in principle desirable for obtaining components that can withstand high mechanical loading and have a low weight. On the other hand, it is also intended to be possible for high-strength components to comprise partially soft regions, by means of which it is possible to achieve the desired, slightly greater deformability in the event of a crash. Only in this way can the kinetic energy of an impact be reduced and the acceleration forces acting on occupants and the rest of the vehicle can therefore be minimized. In addition, modern joining methods require softened points that allow the same or different materials to be joined. Lock seams, crimp connections or riveted connections that require deformable regions in the component often have to be used, for example.

In addition, soft edge regions of the component already allow for contour cutting in the die and complex laser cutting can therefore be rendered obsolete.

In this case, the general demands placed on a production system should still be taken into consideration: the press-hardening system should therefore not encounter any cycle time losses; the entire system should be used unrestrictedly and universally, and quick, product-specific modification of said system should be possible. The process should be robust and economical, and the production system should only require a minimal amount of space. The component should have a high degree of shape and edge accuracy.

In all known methods, the component is targetedly heat-treated in a time-consuming treatment step, which substantially influences the cycle time of the entire heat-treatment device.

Therefore, the object of the invention is to provide a method and a device for targetedly heat-treating individual zones of a steel component, whereby regions of varying hardness and ductility can be produced that minimize the influence of said treatment step on the cycle time of the overall heat-treatment device.

This object is achieved according to the invention by a method having the features of independent claim 1. Advantageous developments of the method can be found in dependent claims 2 to 8. The object is also achieved by a device according to claim 9. Advantageous embodiments of the device can be found in dependent claims 10 to 17.

The method according to the invention for targetedly heat-treating individual zones of a steel component, it being possible to form a primarily austenitic structure in one or more first regions of the steel component, from which austenitic structure a predominantly martensitic structure can be produced by means of quenching, and it being possible to form a predominantly ferritic-pearlitic structure in one or more second regions, and it being possible to form a predominantly bainitic structure in one or more third regions, is characterized in that the steel component is first heated in a first furnace to a temperature that is below the AC3 temperature, the steel component is then transferred to a treatment station, it being possible for said component to cool down whilst being transferred, and the one or more first regions and the one or more third regions of the steel component are heated in the treatment station to a temperature that is above the AC3 temperature within a dwell time $t_{151}$, the third region or third regions of the steel component then being cooled to the cooling stop temperature $\vartheta_s$ and the steel component then being transferred to a second furnace in which the steel component remains at a temperature that is below the austenitising temperature until a sufficiently bainitic structure has been formed in the third region or third regions.

For this purpose, a heat-treatment device according to the invention comprises a first furnace for heating a steel component to a temperature that is below the AC3 temperature, a treatment station and a second furnace, the treatment station comprising a device for rapidly heating the first and third regions and a device for rapidly cooling one or more third regions of the steel component, and the second furnace comprising an apparatus for introducing heat.

In an advantageous embodiment of the method, heat is introduced into the second furnace by means of thermal radiation.

A steel component is first heated in a furnace to below the austenitising temperature. The different regions are then subjected to different treatment in a treatment station:

In the treatment station, the first region or first regions is/are first heated to a temperature that is above the AC3 within a few seconds by means of a high-power laser, for example, and therefore the structure is converted into austenite to the greatest possible extent. In a preferred embodiment, the regions irradiated by the laser are precisely defined by channel walls arranged as vertically as possible with respect to the surface of the component.

The first region or first regions are then not subjected to any additional special treatment in the treatment station, i.e. no fluid is blown in and they are not heated or cooled using other special measures. The first region or first regions slowly cool down in the treatment station by means of natural convection and radiation, for example. It has proven advantageous for measures to be taken in the treatment station for reducing the drop in temperature of the first region or first regions. Such measures can, for example, be attaching thermal radiation reflectors and/or insulating surfaces of the treatment station in the region of the first region or first regions.

The second region or second regions are not subjected to any special treatment in the treatment station, i.e. fluid is not blown in and they are not heated or cooled using other special measures. The second region or second regions slowly cool down in the treatment station by means of natural convection and radiation, for example. It has proven advantageous for measures to be taken in the treatment station for reducing the drop in temperature of the second region or second regions. Such measures can, for example, be attaching thermal radiation reflectors and/or insulating surfaces of the treatment station in the region of the second region or second regions.

During the course of the method, the second region or second regions have not been fully austenitised and, even after being pressed out in a subsequent press-hardening method, have low strength values similar to the original strength values of the untreated steel component.

The third region or third regions is/are first heated to a temperature that is above the AC3 within a few seconds in the treatment station by means of a high-power laser, so that the structure is converted into austenite to the greatest possible extent. In a preferred embodiment, the regions irradiated by the laser are precisely defined by channel walls arranged as vertically as possible with respect to the surface of the component.

The third region or third regions are cooled immediately thereafter as quickly as possible within a treatment time $t_{152}$. In a preferred embodiment of the method, the third region or third regions is/are rapidly cooled by a gaseous fluid being blown therein, for example air or a protective gas. In an advantageous embodiment, for this purpose the treatment station comprises a device for blowing fluid into the third region or third regions. This device can comprise one or more nozzles, for example. In an advantageous embodiment of the method, a gaseous fluid, to which water, for example in atomized form, is admixed, is blown into the third region or third regions. For this purpose, in an advantageous embodiment the device comprises one or more atomizing nozzles. Blowing in the gaseous fluid to which water is added, increases heat dissipation from the third region or third regions. Once the treatment time $t_{152}$ has elapsed, the third region or third regions has/have reached a cooling stop temperature $\vartheta_s$. The treatment time $t_{152}$ usually shifts within the range of a few seconds in this case.

According to the invention, after a few seconds in the treatment station, which can also comprise a positioning device for ensuring that the different regions are accurately positioned, the components are conveyed to a second furnace, which preferably does not comprise any special devices for treating the different regions in different ways. Clearly contoured boundaries have already been formed in the treatment station. In one embodiment, only one furnace temperature $\vartheta_4$ is set, i.e. a substantially homogeneous temperature in the entire furnace chamber that is below the austenitising temperature AC3. The temperatures of the individual regions approach one another and warpage of the components is minimized by the small difference in temperature between the regions. The smallest possible expansions in the temperature level of the component have an advantageous effect during further processing in the press.

In another advantageous embodiment of the method, the temperature $\vartheta_4$ inside the second furnace is lower than the AC3 temperature.

In one embodiment, a continuous furnace is advantageously provided as the first furnace. Continuous furnaces generally have a large capacity and are particularly well suited for mass production, since they can be charged and operated without a large amount of effort. However, a batch furnace, for example a chamber furnace, can also be used as the first furnace.

In one embodiment, the second furnace is advantageously a continuous furnace.

If both the first and the second furnace are designed as continuous furnaces, the necessary dwell times for the first and second region or first and second regions can be set on the basis of the component length by setting the conveying speed and the design of the particular furnace length. This can therefore prevent the cycle time of the overall product line comprising a heat-treatment device and a press for subsequent press-hardening from being affected.

In an alternative embodiment, the second furnace is a batch furnace, for example a chamber furnace.

In a preferred embodiment, the treatment station comprises a device for rapidly heating one or more third regions of the steel component. In an advantageous embodiment, the device comprises one or more high-power lasers for irradiating the third region or third regions of the steel component. In a preferred embodiment, the regions are clearly defined by channels having a corresponding shape.

In a preferred embodiment, the treatment station comprises a device for rapidly cooling one or more third regions of the steel component. In an advantageous embodiment, the device comprises a nozzle for blowing a gaseous fluid, for example air or a protective gas such as nitrogen, into the third region or third regions of the steel component. For this purpose, in an advantageous embodiment the device comprises one or more atomizing nozzles. Blowing in the gaseous fluid to which water is added increases heat dissipation from the third region or third regions.

In another embodiment, the third region or third regions are cooled by means of heat conduction and contact cooling, for example by being brought into contact with a punch or a plurality of punches, which has or have a lower temperature than the steel component. For this purpose, the punch can be made of a thermally conductive material and/or the temperature thereof can be directly or indirectly controlled. A combination of cooling methods is also conceivable.

By means of the method according to the invention and the heat-treatment device according to the invention, steel components each comprising one or more first, second and/or third regions, which may also have a complex shape, can be economically imprinted with a corresponding temperature profile, since the different regions can be heated to the required processing temperatures with sharp contours.

According to the invention, the method shown and the heat-treatment device according to the invention make it possible to provide virtually any number of the three different regions, it also still being possible for different third regions to achieve different strength values from one another, if required.

The chosen geometry of the portions is also freely selectable. Punctiform or linear regions are conceivable, as are regions having a large surface area, for example. The position of the regions does not matter either. The individual regions can be fully enclosed by other regions, or can be located at the edge of the steel component. All-over treatment is even conceivable. For the purpose of the method according to the invention for targetedly heat-treating individual zones of a steel component, the steel component does not need to be oriented in a specific way with respect to the direction of flow. In any case, the number of steel components treated at the same time is limited by the press-hardening die or the materials-handling technology of the overall heat-treatment device. The method can also be applied to already preformed steel components. The three-dimensionally molded surfaces of steel components that have already been preformed merely means that the formation of the mating surfaces involves a greater degree of design complexity.

Furthermore, it is advantageous for it to also be possible to adapt heat-treatment systems that already exist to the method according to the invention. For this purpose, in a conventional heat-treatment device comprising just one furnace, only the treatment station and the second furnace has to be installed downstream of said furnace. Depending on the design of the furnace provided, it is also possible to divide said furnace so that the first and the second furnace are formed from the initial one furnace.

Figure 2:
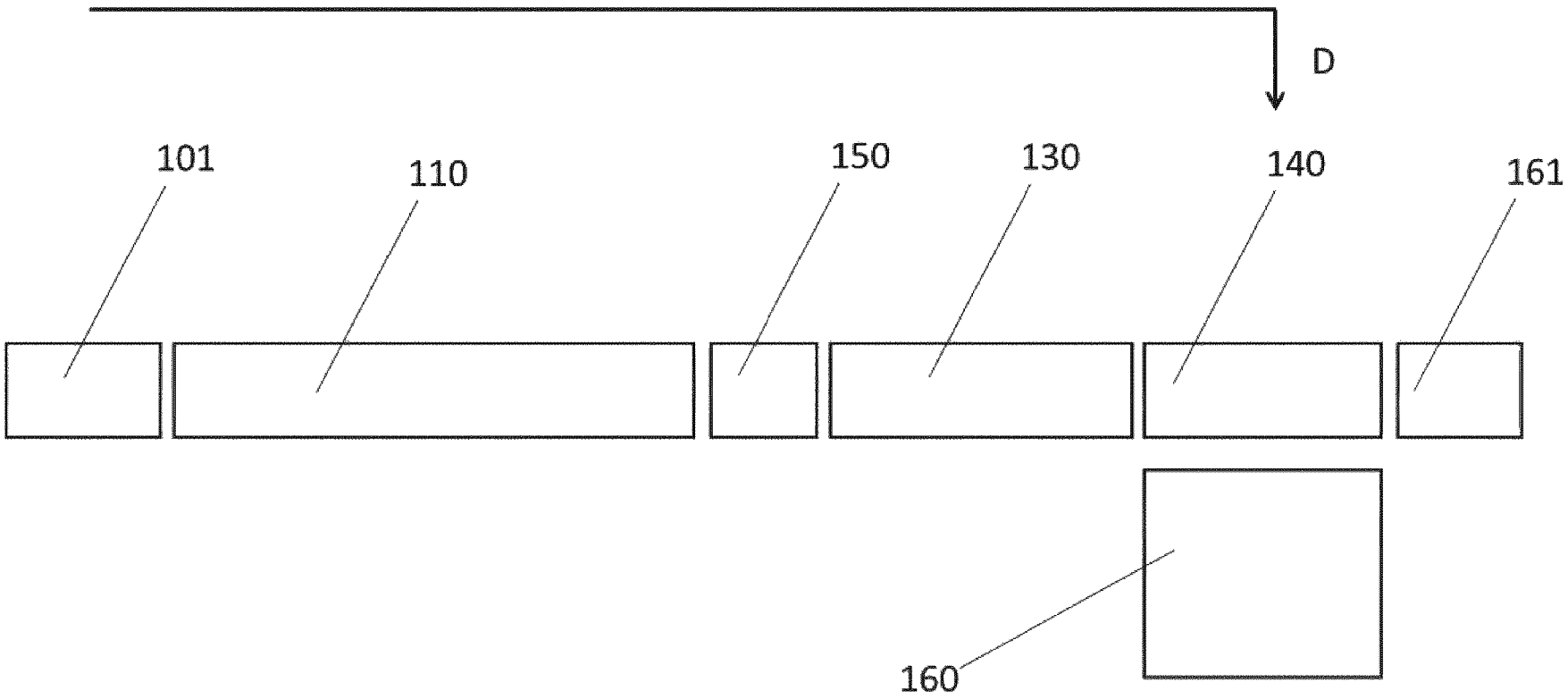
Figure 3:
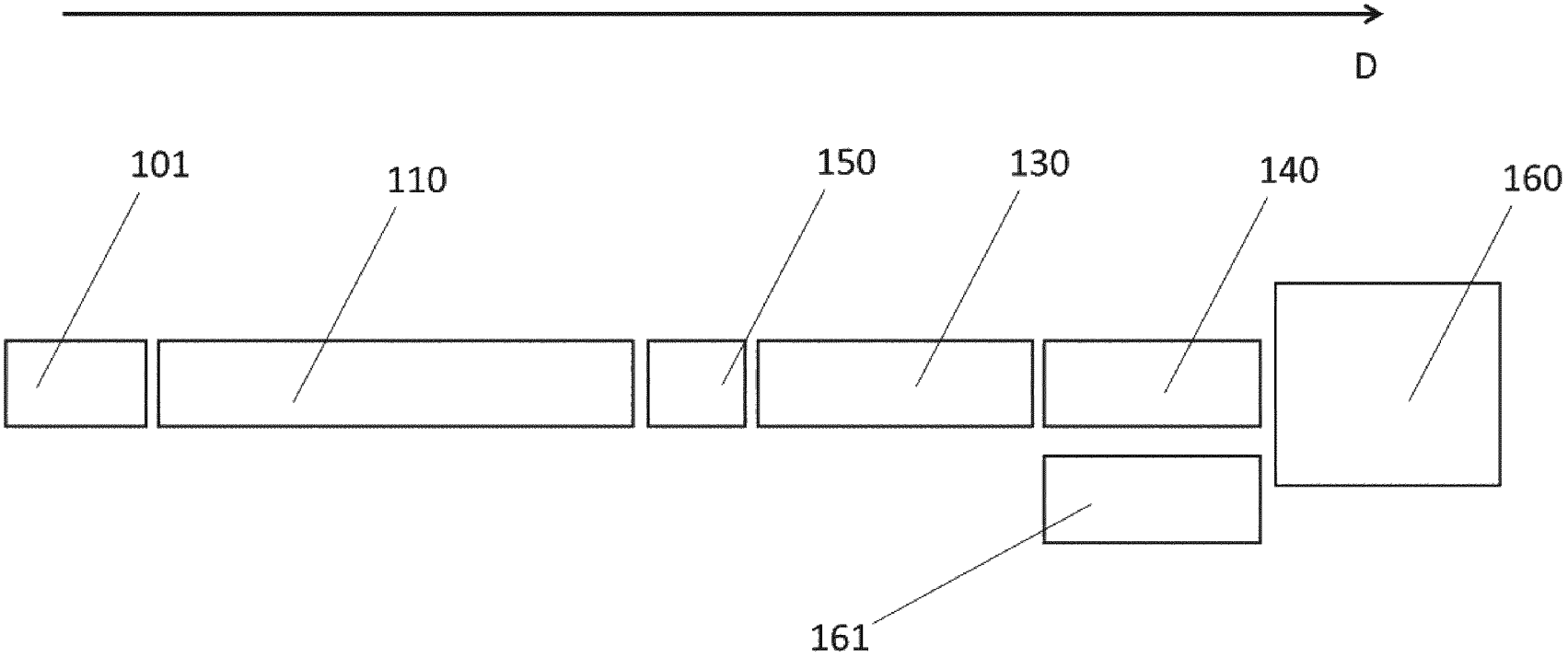
Figure 4:
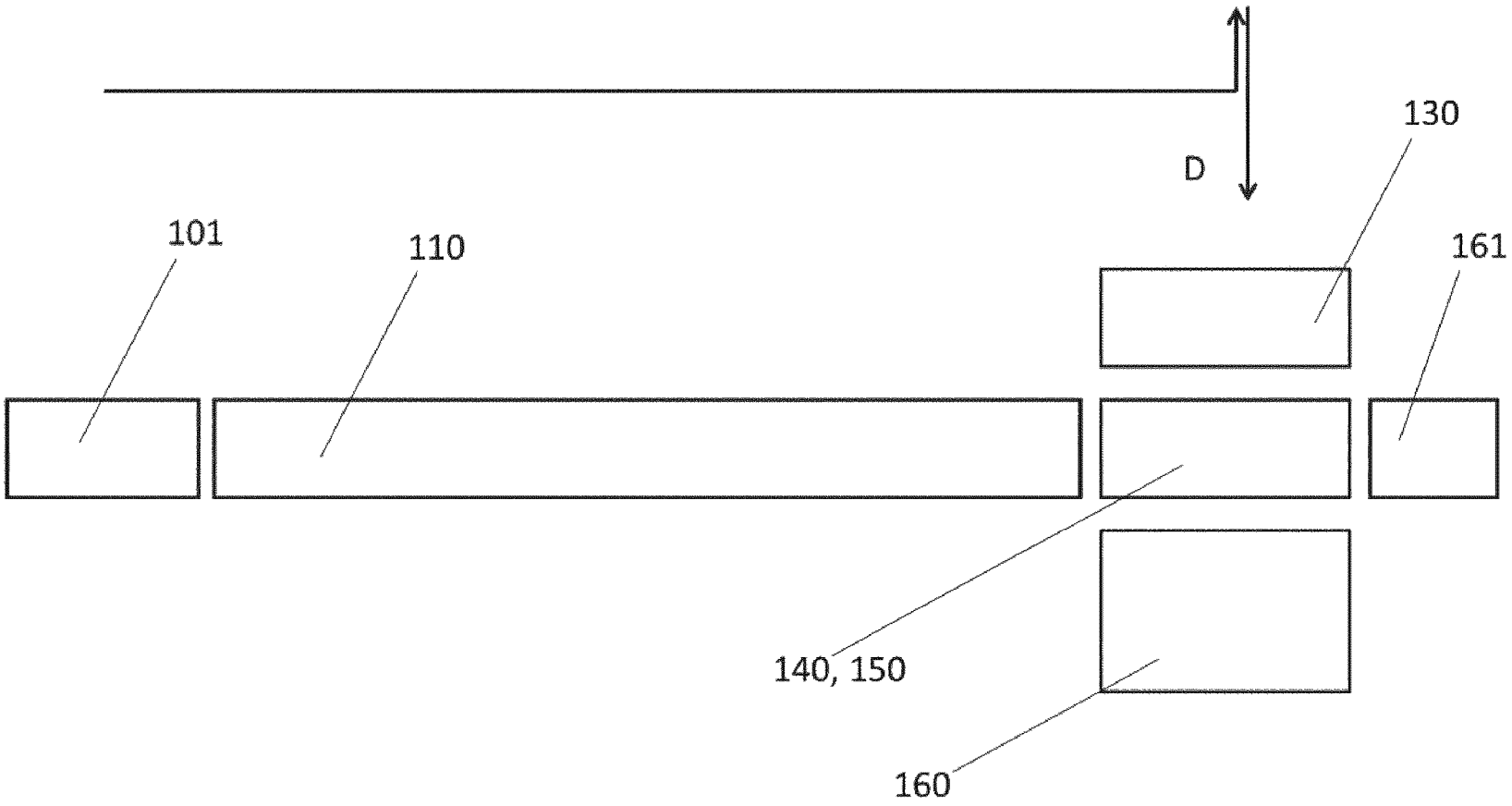
Figure 5:
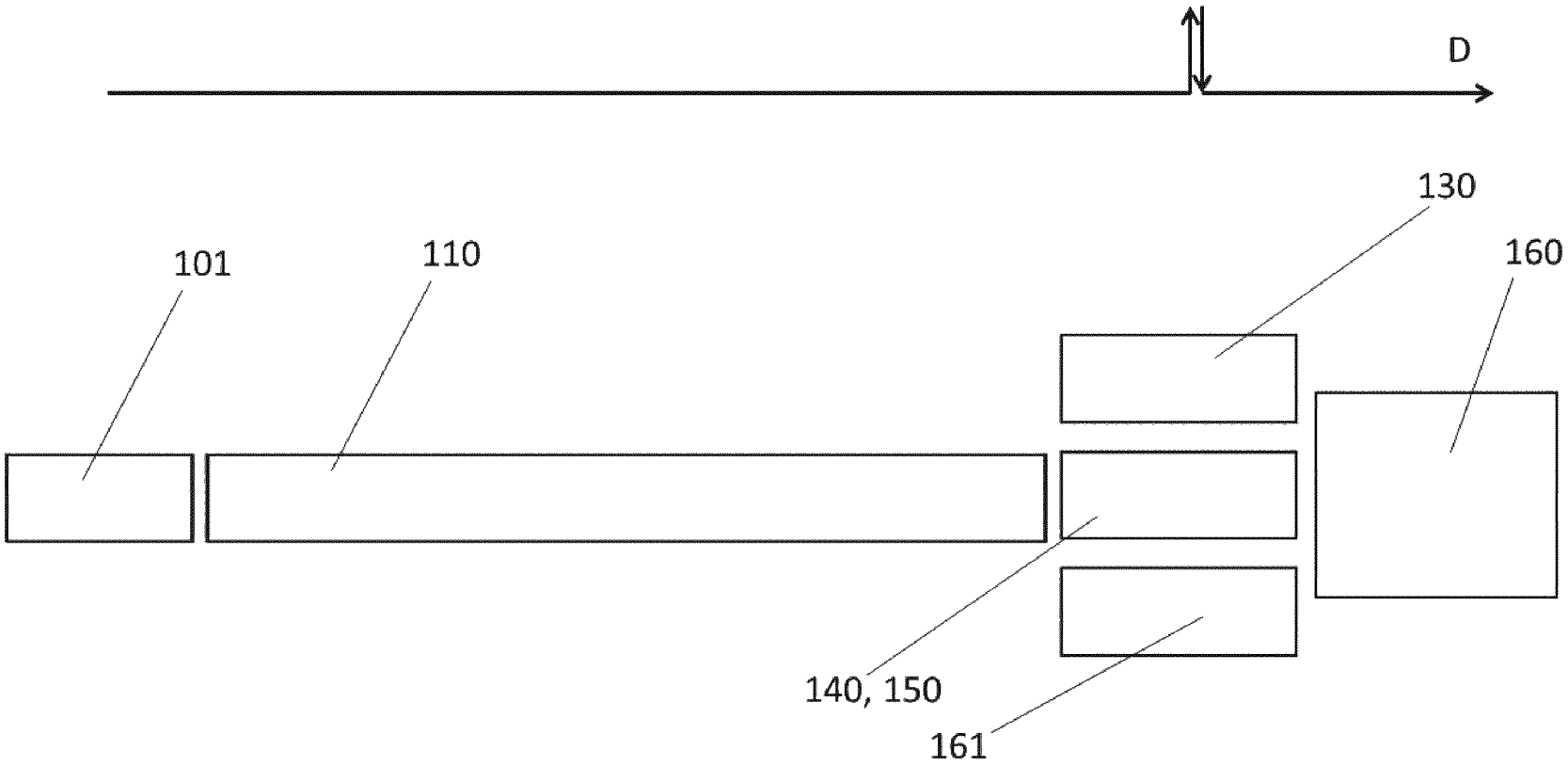
Figure 6:
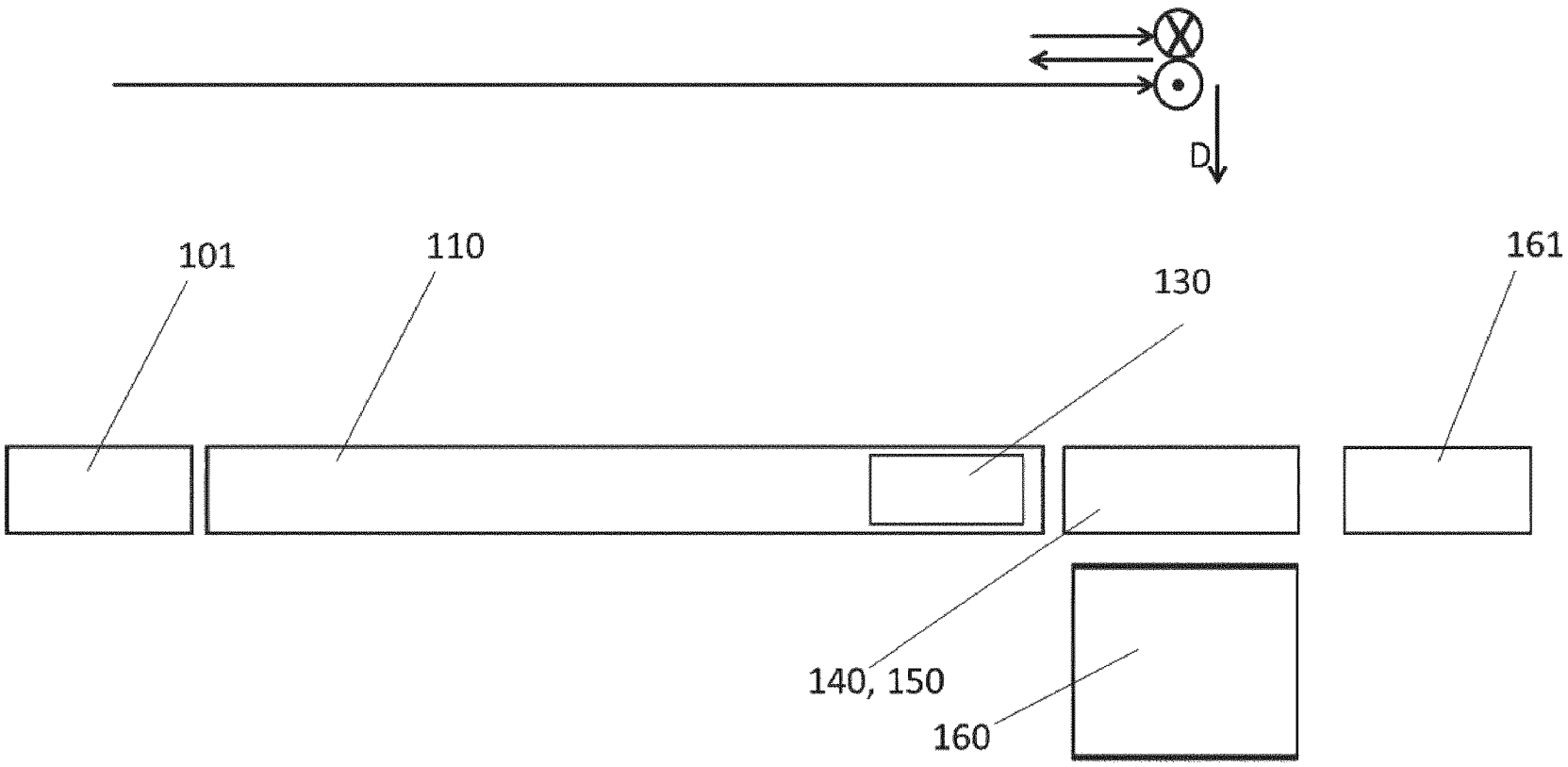
Figure 7:
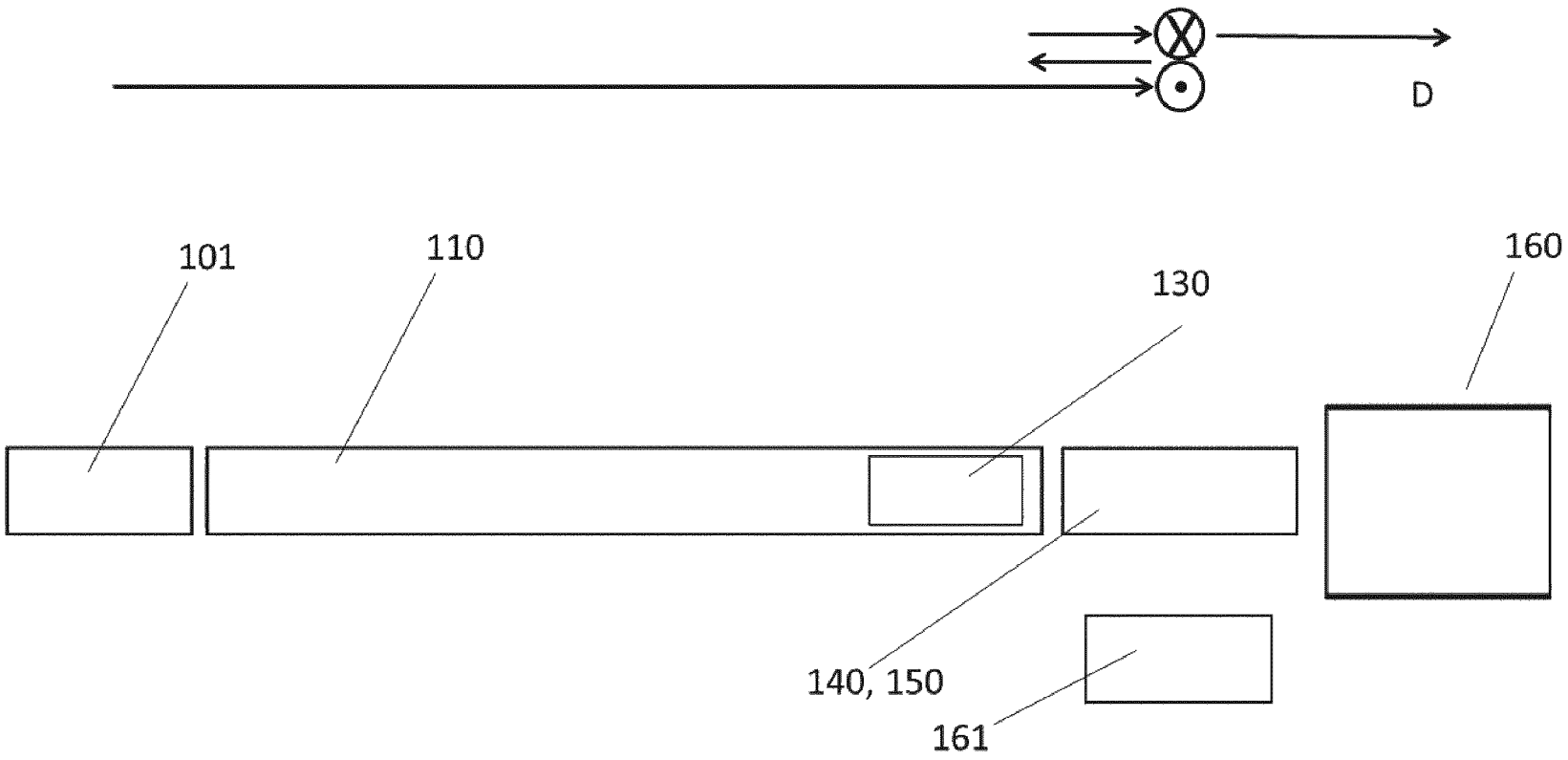

Additional advantages, features and expedient developments of the invention can be found in the dependent claims and the following description of preferred embodiments on the basis of the drawings, in which:

FIG. 1 shows a typical temperature curve when heat-treating a steel component comprising a first, second and a third region, FIG. 2 is schematic plan view of a thermal heat-treatment device according to the invention, FIG. 3 is a schematic plan view of another hermal heat-treatment device according to the invention, FIG. 4 is a schematic plan view of another hermal heat-treatment device according to the invention, FIG. 5 is a schematic plan view of another thermal heat-treatment device according to the invention, FIG. 6 is a schematic plan view of another thermal heat-treatment device according to the invention, and FIG. 7 is a schematic plan view of another thermal heat-treatment device according to the invention.

FIG. 1 shows a typical temperature curve when heat-treating a steel component 200 comprising a first region 210, a second region 220 and a third region 230 according to the method of the invention. Several of each region can be provided, i.e. a plurality of first regions 210, a plurality of second regions 220 and a plurality of third regions 230 can be provided, it being possible to combine any number of regions. The steel component 200 is heated in the first furnace 110 to a temperature below the AC3 temperature during the dwell time $t_{110}$ in accordance with the schematically drawn temperature profile $\vartheta_{200,\ 110}$. The steel component 200 is then transferred to the treatment station 150 at a transfer time $t_{121}$. In this case, the steel component loses heat. In the treatment station, a first region 210 and a third region 230 of the steel component 200 is rapidly heated to above the austenitising temperature AC3 by means of laser radiation, the second region 220 losing heat in accordance with the profile $\vartheta_{220,\ 151}$ or $\vartheta_{220,\ 152}$ drawn. This takes place within a few seconds. Immediately thereafter, the third region 230 is rapidly cooled to the desired cooling stop temperature $\vartheta_s$ in accordance with the temperature profile $\vartheta_{230,\ 152}$ drawn. In this case, the cooling stop temperature $\vartheta_s$ between the individual partial surfaces of the third regions 230 can be different if it is desirable for the third regions 230 within one component to have variable material properties. The third region 230 can be rapidly cooled by a gaseous fluid being blown therein, for example.

No more fluid is blown in once the cooling time $t_{152}$ has elapsed, which only lasts for a few seconds depending on the thickness of the steel component 200. The third region 230 has now reached the cooling stop temperature $\vartheta_s$. At the same time, the temperature of the first region 210 and of the second region 220 in the treatment station 150 has also fallen in accordance with the temperature profiled $\vartheta_{210,\ 152}$ or $\vartheta_{220,\ 151}$, $\vartheta_{220,\ 152}$ drawn.

Once the dwell time $t_{150}$ in the treatment station 150 has elapsed, the steel component 200 is transferred to the second furnace 130 during the transfer time $t_{122}$. In the second furnace 130, the temperature of the first region 210 of the steel component 200 changes during the dwell time $t_{130}$ in accordance with the schematically drawn temperature profile $\vartheta_{210,\ 130}$. The temperature of the second region 220 of the steel component 200 also behaves in accordance with the temperature profile $\vartheta_{220,\ 130}$ drawn during the dwell time $t_{130}$, said temperature profiles not reaching the AC3 temperature. The temperature of the third region 230 of the steel component 200 also behaves in accordance with the temperature profile $\vartheta_{230,\ 130}$ drawn during the dwell time $t_{130}$, without reaching the AC3 temperature.

The second furnace 130 does not comprise any special devices for treating the different regions 210, 220, 230 in different ways. Merely one furnace temperature $\vartheta_4$, i.e. a substantially homogeneous temperature $\vartheta_4$ is set in the overall interior of the second furnace 130, which is below the austenitising temperature AC3.

The steel component can then be transferred during a transfer time $t_{140}$ to a press-hardening die 160, which is integrated in a press (not shown).

Clearly contoured boundaries can be formed between the regions 210, 220, 230 and the small temperature difference minimizes warpage of the steel component 200. Small expansions in the temperature level of the steel component 200 have an advantageous effect during further processing in the press-hardening die 160. The necessary dwell time $t_{130}$ of the steel component 200 in the second furnace 130 can be set on the basis of the length of the steel component 200 by setting the conveying speed and choosing the length of the second furnace 130. The cycle time of the heat-treatment device 100 is thereby minimally affected, or may not even be affected at all.

FIG. 2 shows a heat-treatment device 100 according to the invention in a 90° arrangement. The heat-treatment device 100 comprises a loading station 101, by means of which steel components are fed to the first furnace 110. Furthermore, the heat-treatment device 100 comprises the treatment station 150 and, arranged downstream thereof in the main direction of flow D, the second furnace 130. Arranged further downstream in the main direction of flow D is a removal station 140, which is provided with a positioning device (not shown). The main direction of flow then deviates by substantially 90° in order to match a press-hardening die 160 in a press (not shown), in which die the steel component 200 is press-hardened. A container 161 is arranged in the axial direction of the first furnace 110 and of the second furnace 130, in which container rejects can be placed. In this arrangement, the first furnace 110 and the second furnace 130 are preferably formed as continuous furnaces, for example roller hearth furnaces.

FIG. 3 shows a straight-line arrangement of a heat-treatment device 100 according to the invention. The heat-treatment device 100 comprises a loading station 101, by means of which steel components are fed to the first furnace 110. Furthermore, the heat-treatment device 100 comprises the treatment station 150 and, arranged downstream thereof in the main direction of flow D, the second furnace 130. Arranged further downstream in the main direction of flow D is a removal station 140, which is provided with a positioning device (not shown). A press-hardening die 160 in a press (not shown), in which the steel component 200 is press-hardened, then follows in the main direction of flow that now continues in a straight line. A container 161 is substantially arranged at 90° to the removal station 131, in which container rejects can be placed. In this arrangement, the first furnace 110 and the second furnace 130 are likewise preferably formed as continuous furnaces, for example roller hearth furnaces.

FIG. 4 shows another variant of a heat-treatment device 100 according to the invention. The heat-treatment device 100 again comprises a loading station 101, by means of which steel components are fed to the first furnace 110. In this embodiment, the first furnace 110 is again preferably formed as a continuous furnace. Furthermore, the heat-treatment device 100 comprises the treatment station 150, which is combined with a removal station 131 in this embodiment. The removal station 140 can comprise a gripping device (not shown), for example. In the removal station 140, the steel components 200 are removed from the first furnace 110 by means of the gripping device, for example. The second region or second regions 220 and/or the third region or third regions 230 is/are heat-treated and the steel component or the steel components 200 is/are loaded in a second furnace 130 that is arranged at substantially 90° to the axis of the first furnace 110. In this embodiment, this second furnace 130 is preferably provided as a chamber furnace, for example comprising a plurality of chambers. Once the dwell time $t_{130}$ of the steel components 200 in the second furnace 130 has elapsed, the steel components 200 are removed from the second furnace 130 via the removal station 140 and placed in an opposite press-hardening die 160 that is integrated in a press (not shown). For this purpose, the removal station 140 can comprise a positioning apparatus (not shown). With respect to the main direction of flow D, a container 161 is arranged downstream of the removal station 140 in the axial direction of the first furnace 110, in which container rejects can be placed. In this embodiment, the main direction of flow D describes a substantially 90° deflection. In this embodiment, a second positioning system for the treatment station 150 is not required. Furthermore, this embodiment is advantageous when there is not enough space available in the axial direction of the first furnace 110, for example in a production hall. In this embodiment, the first region or first regions 210 and the third region or third regions 230 of the steel component 200 can also be heat-treated between the removal station 140 and the second furnace 130 so that a stationary treatment station 150 is not required. For example, the treatment station 150 can be integrated in the gripping device. The removal station 140 ensures that the steel component 200 is transferred from the first furnace 110 to the second furnace 130 and to the press-hardening die 160 or to the container 161.

In this embodiment, too, the press-hardening die 160 and the container 161 can switch positions, as can be seen in FIG. 5. In this embodiment, the main direction of flow D describes two substantially 90° deflections.

If the space in which the heat-treatment device is to be placed is restricted, a heat-treatment device according to FIG. 6 is advantageous: in comparison with the embodiment shown in FIG. 4, the second furnace 130 is moved to a second plane above the first furnace 110. In this embodiment, too, the first region or first regions 210 and the third region or third regions 230 of the steel component 200 can likewise be treated between the removal station 140 and the second furnace 130, so that a stationary treatment station 150 is not required. Once again it is advantageous for the first furnace 110 to be formed as a continuous furnace and for the second furnace 130 to be formed as a chamber furnace, possibly comprising a plurality of chambers.

Lastly, FIG. 7 is a schematic view of a final embodiment of the heat-treatment device according to the invention. In comparison with the embodiment shown in FIG. 6, the press-hardening die 160 and the container 161 have switched positions.

The embodiments shown here only represent examples of the present invention and should therefore not be taken to be limiting. Alternative embodiments that a person skilled in the art would take into consideration are likewise covered by the scope of protection of the present invention.

LIST OF REFERENCE SIGNS

- 100 heat-treatment device
- 101 loading station
- 110 first furnace
- 130 second furnace
- 140 removal station
- 150 treatment station
- 151 high-power laser
- 152 cooling apparatus
- 160 press-hardening die
- 161 container
- 200 steel component
- 210 first region
- 220 second region
- 230 third region
- D main direction of flow
- $t_{110}$ dwell time in the first furnace
- $t_{121}$ transfer time of the steel component to the treatment station
- $t_{122}$ transfer time of the steel component to the second furnace
- $t_{130}$ dwell time in the second furnace
- $t_{140}$ transfer time of the steel component to the press-hardening die
- $t_{150}$ dwell time in the treatment station
- $t_{151}$ heating-up time in the treatment station
- $t_{152}$ cooling time in the treatment station
- $t_{160}$ dwell time in the press-hardening die
- $\vartheta_s$ cooling stop temperature
- $\vartheta_3$ temperature inside the first furnace
- $\vartheta_4$ temperature inside the second furnace
- $\vartheta_{200,\ 110}$ temperature profile of the steel component in the first furnace
- $\vartheta_{210,\ 151}$ temperature profile of the first region of the steel component in the treatment station during heating
- $\vartheta_{220,\ 151}$ temperature profile of the second region of the steel component in the treatment station
- $\vartheta_{220,\ 152}$ temperature profile of the second region of the steel component in the treatment station $\vartheta_{230,\ 152}$ temperature profile of the third region of the steel component in the treatment station during cooling $\vartheta_{210,\ 130}$ temperature profile of the first region of the steel component in the second furnace $\vartheta_{220,\ 130}$ temperature profile of the second region of the steel component in the second furnace $\vartheta_{230,\ 130}$ temperature profile of the third region of the steel component in the second furnace $\vartheta_{200,\ 160}$ temperature profile of the steel component in the press-hardening die

The invention claimed is:

1. A method for carrying out targeted heat-treatment of individual zones of a steel component, said method comprising:

forming a primarily austenitic structure in a first region of the steel component, wherein the primarily austenitic structure, when quenched, forms a predominantly martensitic structure, forming a predominantly ferritic-pearlitic structure in a second region of the steel component, forming a primarily bainitic structure in a third region of the steel component, heating the steel component in a first furnace to a temperature that is below the AC3 temperature, transferring the steel component to a treatment station, cooling down said component while the component is being transferred, heating the first and third regions in the treatment station to a temperature that is above the AC3 temperature within a dwell time t151, cooling the third region to the cooling stop temperature $\vartheta$s, and transferring the steel component to a second furnace in which the steel component remains at a temperature that is below the austenitizing temperature until a sufficiently bainitic structure has been formed in the third region.

2. The method according to claim 1, further comprising supplying heat to the second furnace via thermal radiation.

3. The method according to claim 1, further comprising, within the treatment station, using a high-power laser to heat the first region to a temperature that is above the austenitizing temperature within a dwell time t151.

4. The method according to claim 1, further comprising, within the treatment station, using a high-power laser to heat the third region to a temperature that is above the austenitizing temperature within a dwell time t151.

5. The method according to claim 1, further comprising, within the treatment station, blowing a gaseous fluid against the third region within a dwell time t152 in order to cool them.

6. The method according to claim 5, wherein the gaseous fluid contains water.

7. The method according to claim 1, further comprising, within the treatment station, bringing the third region into contact with a punch within a dwell time t152 in order to cool the third region, the punch having a lower temperature than that of the third region.

8. The method according to claim 1, further comprising maintaining a temperature $\vartheta$4 inside the second furnace to be lower than the AC3 temperature.

9. The method of claim 1, after a sufficiently bainitic structure has been formed in the third region, quenching the steel component.

10. The method of claim 1, after a sufficiently bainitic structure has been formed in the third region, press hardening the steel component.

* * * * *